US005315836A

United States Patent [19]

Ressler

[11] Patent Number: 5,315,836

[45] Date of Patent: May 31, 1994

[54] AIR COOLING UNIT HAVING A HOT GAS DEFROST CIRCUIT

[75] Inventor: Thomas B. Ressler, West Linn, Oreg.

[73] Assignee: McCormack Manufacturing Co., Inc., Lake Oswego, Oreg.

[21] Appl. No.: 5,021

[22] Filed: Jan. 15, 1993

[51] Int. Cl.[5] ..... F25B 41/00

[52] U.S. Cl. ..... 62/81; 62/277

[58] Field of Search ..... 62/278, 277, 272, 80, 62/81

[56] References Cited

U.S. PATENT DOCUMENTS

| | | | |
|---|---|---|---|
| 2,998,712 | 9/1961 | Watkins | 62/278 |
| 3,091,942 | 6/1963 | Dickson et al. | 62/89 |
| 3,195,321 | 7/1965 | Decker et al. | 62/278 |
| 3,381,494 | 5/1968 | Steelman | 62/283 |
| 3,817,049 | 6/1974 | Lim et al. | 62/80 |
| 4,152,900 | 5/1979 | Chopra et al. | 62/80 |
| 4,756,358 | 7/1988 | O'Neal | 165/1 |

*Primary Examiner*—John M. Sollecto

*Attorney, Agent, or Firm*—Marger Johnson McCollom & Stolowitz

[57] ABSTRACT

An air cooling unit having a hot gas defrost coil disposed below the air cooling coil assembly proximate the condensate pan and a hot gas defrost pipe disposed proximate the lower front edge of the air cooling coil assembly for receiving a heated refrigerant gas.

14 Claims, 4 Drawing Sheets

AIR COOLING UNIT HAVING A HOT GAS DEFROST CIRCUIT

BACKGROUND OF THE INVENTION

1. Field of the Invention

This invention relates to refrigeration units which cool air by drawing it over finned coils through which a refrigerant is flowing, and in particular, to a refrigeration unit incorporating a hot gas defrost circuit including an anti-bridging circuit.

2. Description of Related Art

Air cooling units are widely used to cool a variety of storage and working spaces, such as storage areas for produce, meat and frozen goods. In general, air cooling units comprise a finned coil assembly through which a refrigerant is directed, an electrically driven fan for drawing or pushing air through the finned coils, and a condensate collection pan fitted below the finned coil assembly to collect and divert water condensed from the air as it passes over the coils and is cooled below its dew point. The condensate pan is fitted with a drain through which the condensate is directed to the building drain system as appropriate. A compressor and condenser assemblies are also required for providing refrigerant to the cooling coils. The compressor and condenser assemblies are usually provided as separate units, and may be located remotely from the air cooling unit.

During normal operation, it is common for condensate collecting on the coils and in the condensate pan to periodically freeze. Therefore, air cooling units are usually fitted with a defrost mechanism, which is usually located in the condensate pan directly below the lower end of the cooling coil assembly. The defrost unit may either be an electrical resistance heater, or may consist of a separate coil assembly for receiving hot refrigerant gas from the outlet of the refrigeration compressor. The defrost mechanism may be activated periodically at predetermined intervals, or may be activated in response to a buildup of frost detected either visually or by other means. In spite of the presence of either electric or hot gas defrosters however, the area between the front edge of the condensate pan and the lower front edge of the cooling coil assembly can be the plagued by a buildup of ice which is not adequately alleviated by known defrosting mechanisms. Once a buildup of frozen condensate occurs in this area, freezing of the condensate in the condensate pan is more frequent, requiring more frequent defrost cycles, or perhaps resulting in overflow of condensate onto the floor below, causing a slipping hazard and maintenance problem.

As a result, there remains a need for an improved refrigeration cooling unit defroster which in addition to defrosting the cooling coils and a major portion of the condensate pan, further insures effective defrosting of the area between the lower front edge of the cooling coil assembly, the condensate pan and its drain.

SUMMARY OF THE INVENTION

It is an object of the present invention therefore to provide an improved air cooling unit for use in cooling refrigerated spaces, for example, which includes an improved hot-gas defrost mechanism which provides improved defrosting of the lower front air inlet, of the condensate pan, and its drain.

An improved air cooling unit is provided which comprises an air cooling coil assembly, and a hot gas defrosting coil disposed below the air cooling coil assembly. An anti-bridging pipe is disposed at the lower edge of the air inlet. Means are provided for periodically conducting a flow of a heated defrosting gas through the hot gas defrosting coil. Means are also provided for periodically or continuously conducting a portion of the heated defrosting gas through the anti-bridging pipe to melt frozen condensate which has accumulated therein.

The anti-bridging pipe inlet may receive hot gas form the hot gas defrosting coil, or alternatively directly from a refrigerant compressor discharge line. The anti-bridging pipe may include an outlet which communicates with the hot gas defrosting coil, or which communicate with the air cooling coil assembly discharge pipe.

These and other features of the invention will now be described with reference to the drawings of the preferred embodiment.

DETAILED DESCRIPTION OF THE PREFERRED EMBODIMENT

Figure 1:
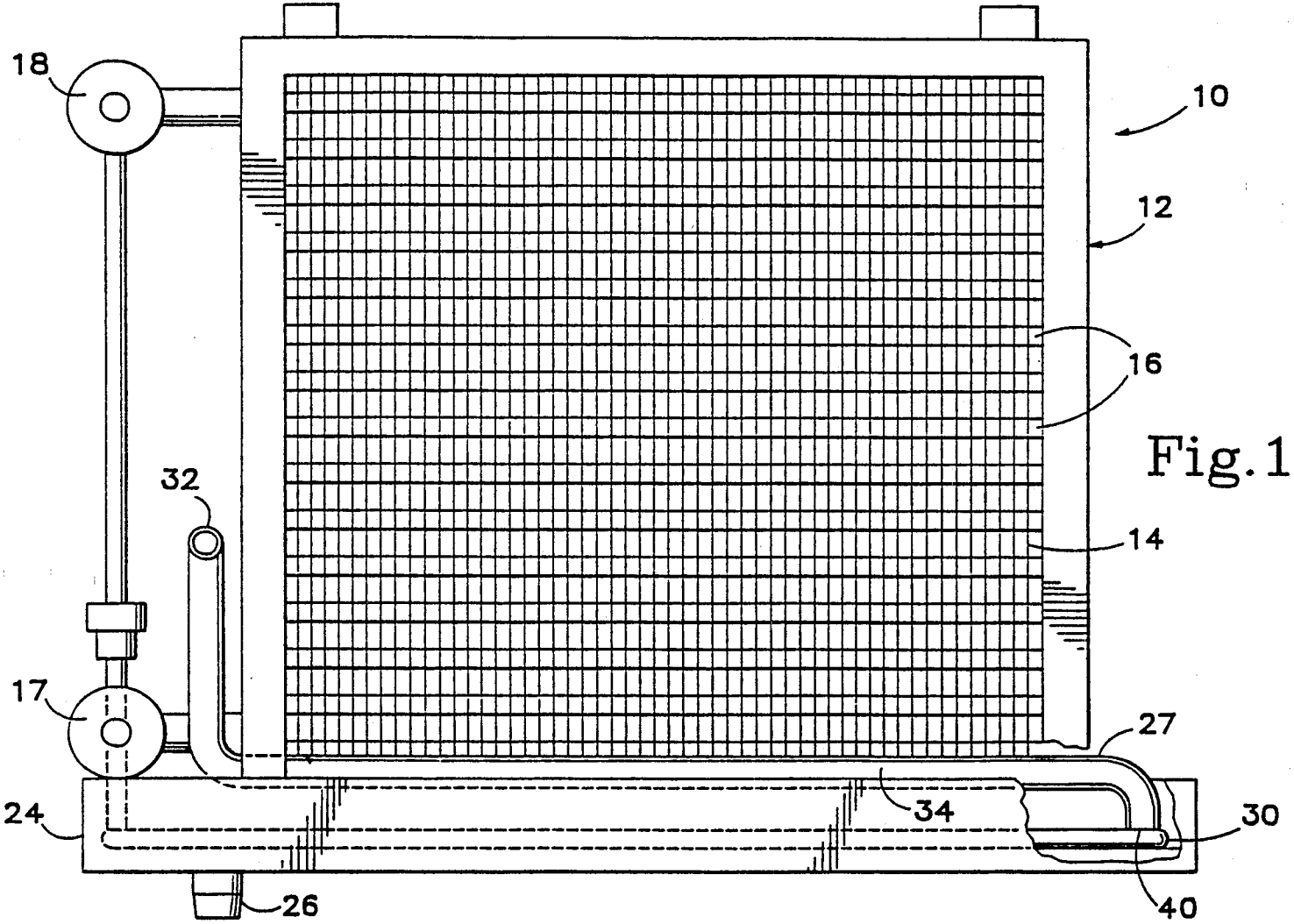
FIG. 1 is a rear view of a refrigeration unit embodying the present invention.
Figure 2:
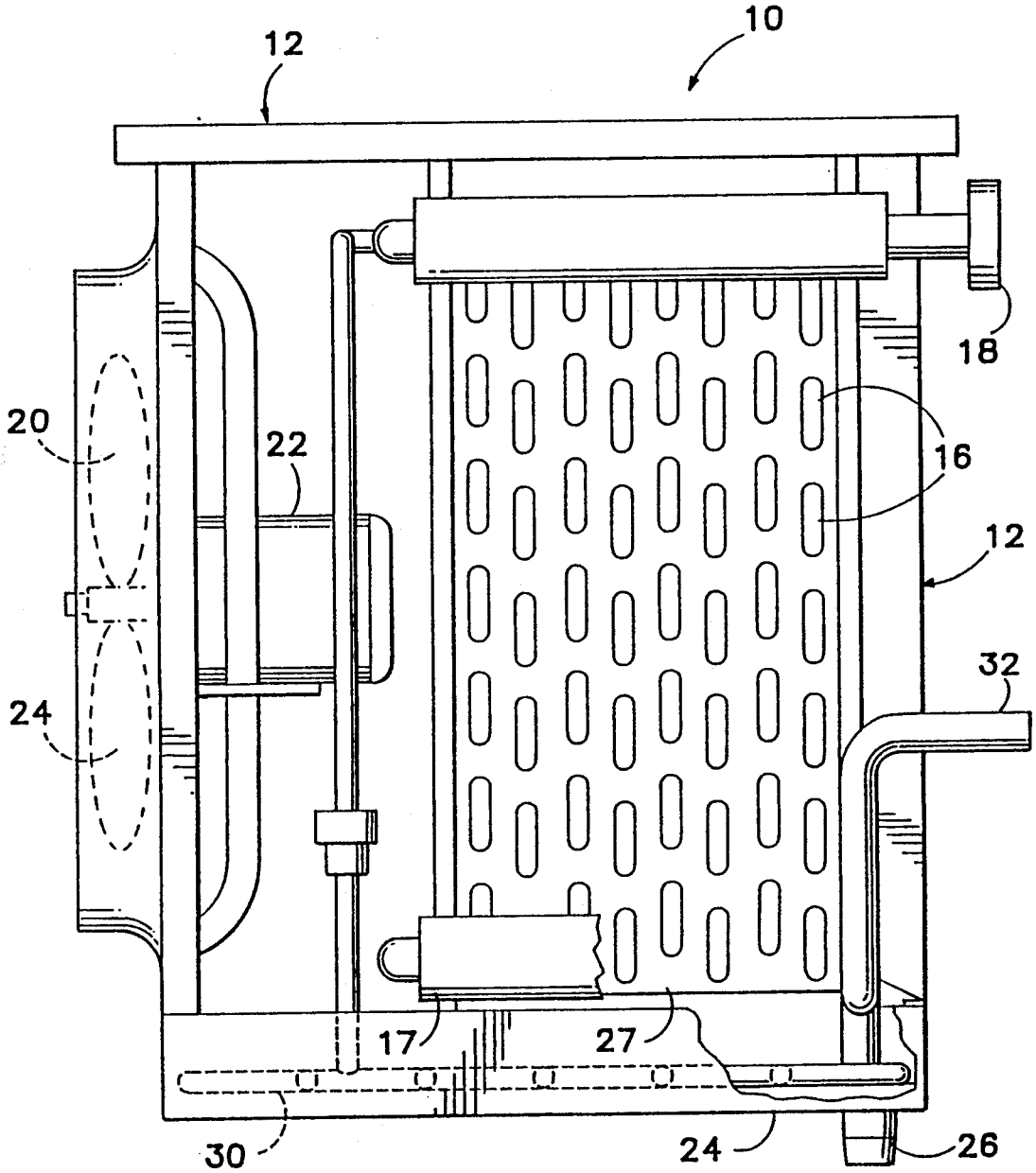
FIG. 2 is a side view of the cooler of FIG. 1, including a partial cut away view of the lower air inlet.

Referring to FIGS. 1 and 2, there is shown at 10 a refrigeration air cooling unit having an outer housing 12, including an open rear end 14 through which air is drawn into cooler 10. Disposed within housing 12 is a finned cooling coil assembly 16 through which a refrigerant is passed. The refrigerant is received into cooling coil assembly 16 from a compressor assembly (not shown) through inlet pipe 17, and is discharged to a condenser assembly (not shown) through an outlet pipe 18. A fan assembly 20 is mounted to housing 12 and is positioned in front of fin cooling coil assembly 16. Electric motor 22 drives fan 24, which draws air through the rear opening of housing 12 and across finned cooling coil assembly 16. The cooled air is then discharged into the surrounding space. Located below cooling coil assembly 16 is a condensate pan 24, which includes drain 26 for draining the collected condensate from the unit.

Figure 3:
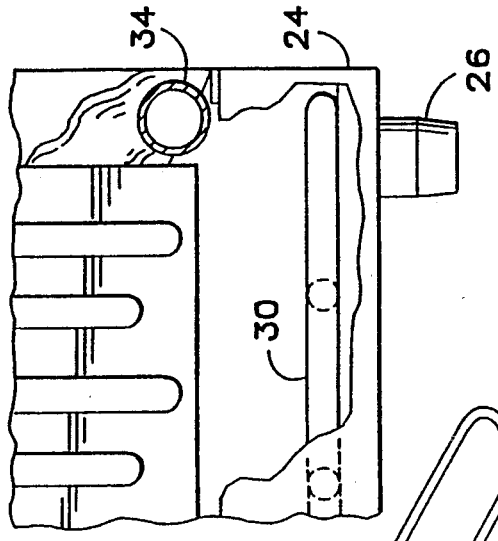
FIG. 3 is a partial cutaway view of a typical refrigeration unit showing an accumulation of ice in the lower air inlet area.

Periodically, the condensate will freeze in condensate pan 24, and frequently on the lower coils of cooling coil assembly 16 as well. To melt the frozen condensate, a gas defrost coil 30 is fitted in condensate pan 24. Turning now to FIG. 3, hot refrigerant gas from the compressor enters hot-gas defrost coil 30 through inlet 32, flows through the coil, and is discharged into cooling coil outlet pipe 16. The hot refrigerant gas is a portion of the refrigerant which is provided to cooling coil assembly 16, but which has been diverted from the compressor discharge line prior to being passed through the refrigerant condensor, according to principles well-known to designers of hot-gas defrost units.

In addition to condensate freezing in condensate pan 24, condensate also tends to accumulate and freeze at the lower front edge of the cooling coil assembly 16, and at the bottom by condensate pan 24 as shown in FIG. 3. In addition, the frozen condensate in contact with condensate pan 24, which is normally metal, cools the area of the condensate pan 24 in the vicinity of drain 26, leading to more frequent and persistent blockage of drain 26. Hot-gas defrost coils of known configuration are unable to adequately defrost lower edge of cooling coil assemble 16, and are therefore ineffective in maintaining the cooling unit in an operational condition.

Figure 4:
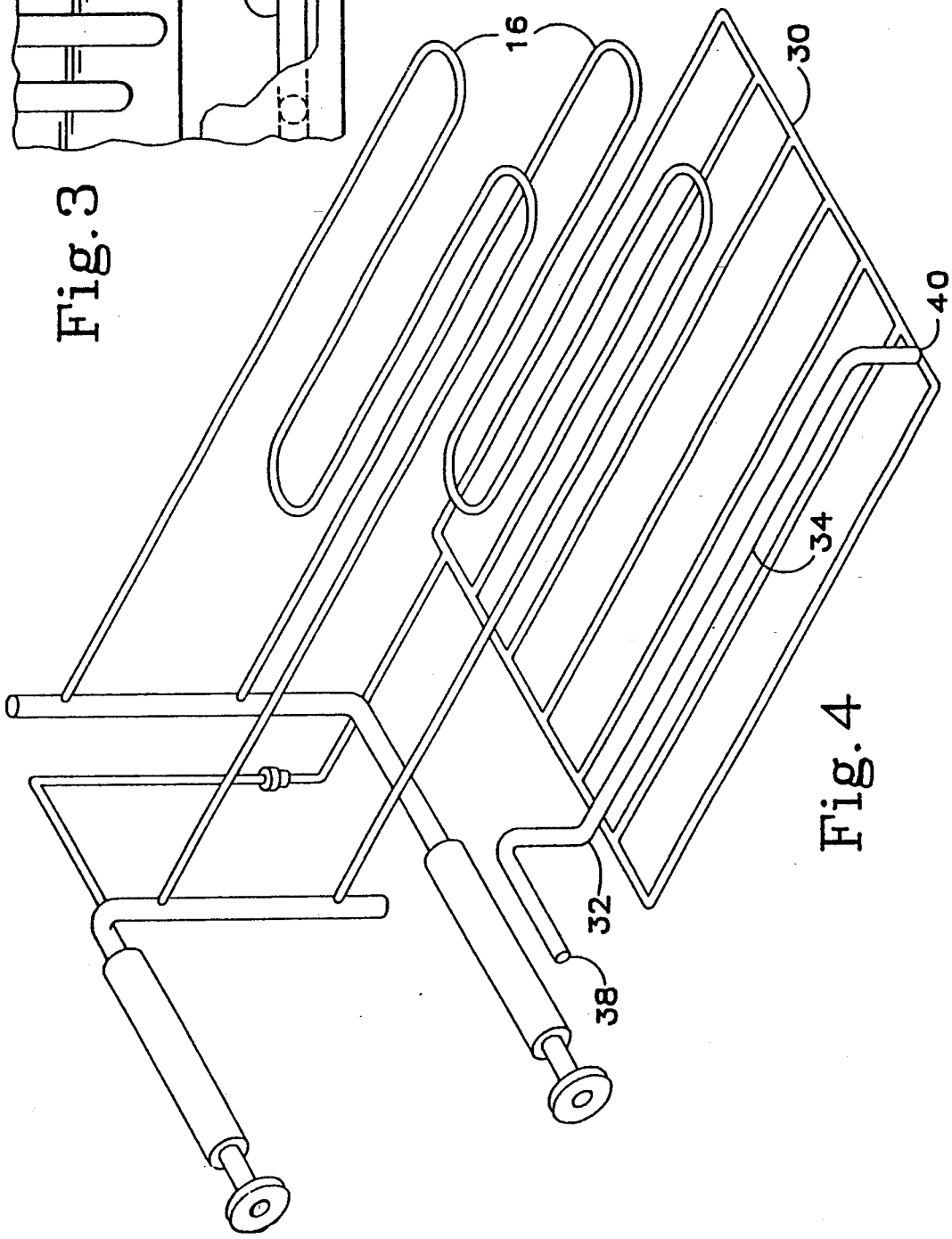
FIG. 4 is a schematic view of a hot gas defroster including an anti-bridging circuit according to one embodiment of the present invention.
Figure 5:
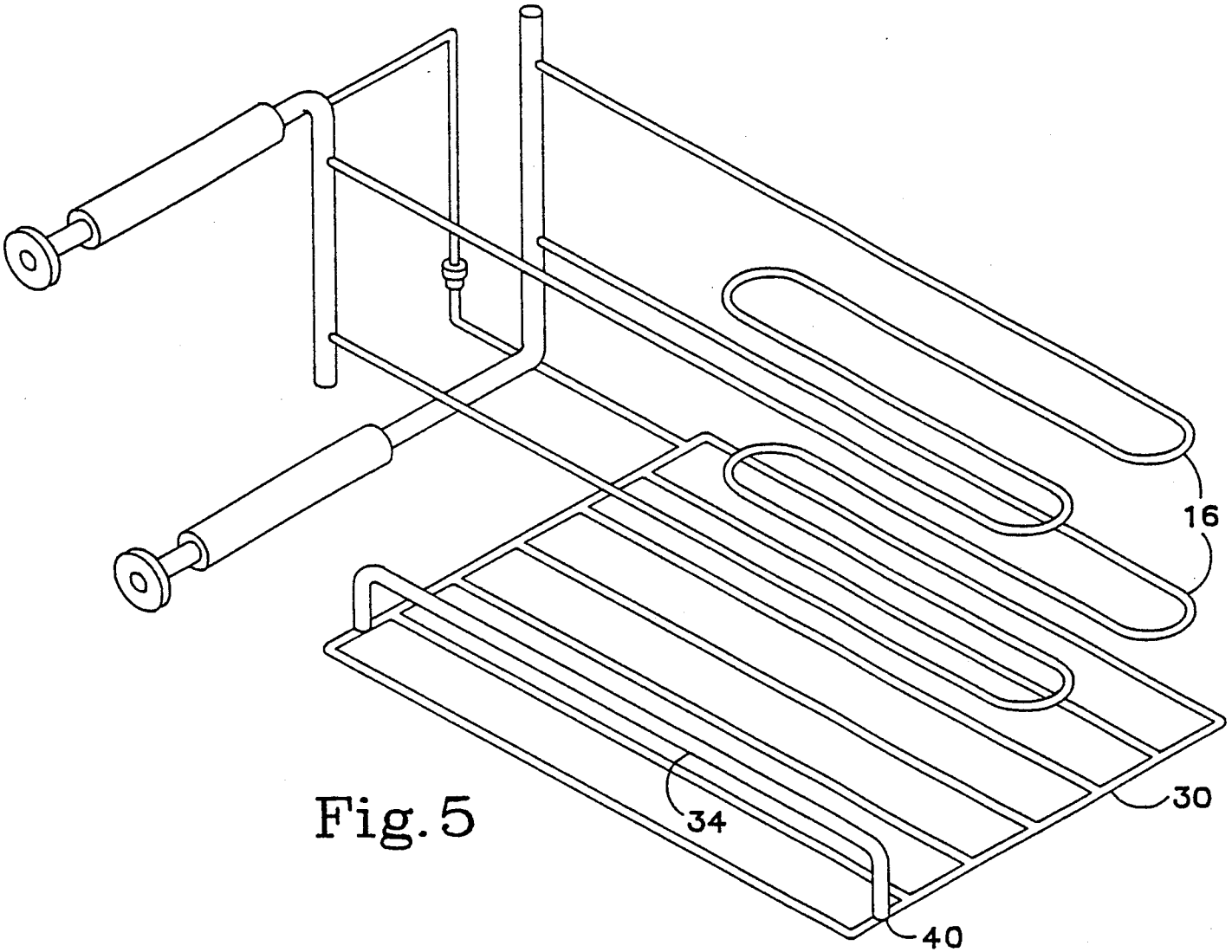
FIG. 5 is a schematic view of a hot gas defroster including an anti-bridging circuit according an alternative embodiment of the present invention.

Applicant has recognized the compounding nature of the problem caused by the bridging of lower opening 27 for the first time, and has recognized a novel solution. According to the present invention, an anti-bridging pipe 34 is placed lengthwise in lower opening 27 as shown in FIGS. 1 and 2. As best shown in FIG. 4, anti-bridging pipe 34 is connected at its inlet 36 to refrigerant compressor discharge line 38 and at its outlet end 40 to hot gas coil 30 located in condensate pan 24. In an alternative embodiment shown in FIG. 5, the inlet of anti-bridging pipe 34 may be connected to an inlet pipe of hot gas defrosting coil 30. Anti-bridging pipe 34 is preferably constructed of copper for its desirable heat transfer characteristics. It will be recognized that other materials of construction could be readily employed as well. If desired, fins could also be provided according to known principles to enhance its effectiveness.

In operation, hot gas may be directed through anti-bridging pipe 34 periodically as required to melt any accumulation of frozen condensate, or, a flow of hot gas may be provided continuously through anti-bridging pipe 34 to continuously heat the air flowing through lower opening 27. The continuous heating serves the dual purposes of slowing or preventing the freezing of condensate in lower opening 27, and of providing heat to condensate in condensate pan 24 to slow or prevent its freezing. The combined effect is to slow or prevent frost buildup on the coil assembly and to slow or prevent the freezing of drain 26, which together allow for more trouble-free operation of the unit.

As described, the present invention provides a cooler in which the recurring problem of the freezing of condensate in the condensate pan, and particularly in the region of drain 26, is reduced and frequently eliminated entirely, thereby enhancing operation of the refrigeration cooling unit. It will be recognized by those skilled in the art that numerous modifications in detail and materials of construction could be made without departing from the scope of the following claims. It is intended that the claims encompass all such modifications.

I claim:

1. An improved air cooling unit comprising;

an air cooling coil assembly having a lower edge;

a condensate pan below the air cooling assembly, and which includes a condensate drain;

a hot gas defrosting coil disposed below the air cooling coil assembly proximate the condensate pan;

means for periodically conducting a flow of a heated defrosting gas through the hot gas defrosting coil;

an anti-bridging pipe disposed in the path of a stream of air between the air cooling coil assembly lower edge and over a front edge of the drain pan; and means for periodically conducting a portion of the heated defrosting gas through the anti-bridging pipe.

2. A refrigeration unit according to claim 1 wherein the anti-bridging pipe includes an inlet which communicates with the hot gas defrosting coil.

3. A refrigeration unit according to claim 1 wherein the anti-bridging pipe includes an outlet which communicates with the hot gas defrosting coil.

4. A refrigeration unit according to claim 1 wherein the heated defrosting gas comprises a heated refrigerant gas which periodically flows through the air cooling coil assembly.

5. A refrigeration unit according to claim 1 wherein the heated defrosting gas comprises a heated refrigerant gas which continuously flows through the air cooling coil assembly.

6. A refrigeration unit according to claim 1 wherein the anti-bridging pipe is disposed generally parallel to the air cooling coil assembly lower edge.

7. A refrigeration unit according to claim 1 wherein the air cooling coil assembly includes a refrigerant discharge pipe, and wherein the hot gas defrosting coil includes an outlet which communicates with the air cooling coil assembly discharge pipe.

8. A method of operating an air cooling unit having an air cooling coil assembly including a lower edge, a condensate pan below the air cooling coil assembly, and which includes a condensate drain, a hot gas defrosting coil disposed below the air cooling coil assembly proximate the condensate pan, means for periodically conducting a flow of a heated defrosting gas through the hot gas defrosting coil, the method comprising:

providing an anti-bridging pipe disposed in the path of a stream of air between the air cooling coil assembly lower edge and over a front edge of the drain pan; and periodically conducting a portion of the heated defrosting gas through the air cooling coil assembly defrosting pipe.

9. A method according to claim 8 wherein the anti-bridging pipe includes an inlet which communicates with the hot gas defrosting coil.

10. A method according to claim 8 wherein the anti-bridging pipe includes an outlet which communicates with the hot gas defrosting coil.

11. A method according to claim 8 wherein the heated defrosting gas comprises a heated refrigerant gas which periodically flows through the air cooling assembly.

12. A method according to claim 8 wherein the heated defrosting gas comprises a heated refrigerant gas which continuously flows through the air cooling coil assembly.

13. A method according to claim 8 wherein the anti-bridging pipe is disposed generally parallel to the air cooling coil assembly lower edge.

14. A method according to claim 8 wherein the air cooling coil assembly includes a refrigerant discharge pipe, and wherein the hot gas defrosting coil includes an outlet which communicates with the air cooling coil assembly discharge pipe.

* * * * *